US009277342B2

(12) United States Patent
Lukasczyk et al.

(10) Patent No.: US 9,277,342 B2
(45) Date of Patent: Mar. 1, 2016

(54) METHOD AND DEVICE FOR TESTING A LOUDSPEAKER ARRANGEMENT

(71) Applicants: Thomas Lukasczyk, Rossdorf (DE); Waldemar Rempel, Michelstadt (DE)

(72) Inventors: Thomas Lukasczyk, Rossdorf (DE); Waldemar Rempel, Michelstadt (DE)

(73) Assignee: Continental Automotive GmbH, Hannover (DE)

( * ) Notice: Subject to any disclaimer, the term of this patent is extended or adjusted under 35 U.S.C. 154(b) by 86 days.

(21) Appl. No.: 14/361,722

(22) PCT Filed: Nov. 30, 2012

(86) PCT No.: PCT/EP2012/074020

§ 371 (c)(1),
(2) Date: May 30, 2014

(87) PCT Pub. No.: WO2013/079629

PCT Pub. Date: Jun. 6, 2013

(65) Prior Publication Data

US 2015/0036833 A1 Feb. 5, 2015

(30) Foreign Application Priority Data

Dec. 2, 2011 (DE) ..... 10 2011 087 676

(51) Int. Cl.
*H04R 29/00* (2006.01)

(52) U.S. Cl.
CPC ..... *H04R 29/001* (2013.01); *H04R 29/003* (2013.01)

(58) Field of Classification Search
CPC ..... H04R 29/001; H04R 29/003
USPC ..... 381/58, 59
See application file for complete search history.

(56) References Cited

U.S. PATENT DOCUMENTS

2005/0175195 A1* 8/2005 Cheney, Jr. ..... G01R 31/041 381/120
2009/0295591 A1 12/2009 Bedingfield

FOREIGN PATENT DOCUMENTS

| | | | |
|---|---|---|---|
| EP | 1 564 561 | A1 | 8/2005 |
| EP | 0 841 570 | A2 | 2/2009 |
| EP | 2 023 670 | A1 | 2/2009 |
| EP | 2 355 542 | A1 | 8/2011 |
| GB | 2 388 916 | | 11/2003 |

* cited by examiner

*Primary Examiner* — Paul S Kim
(74) *Attorney, Agent, or Firm* — Cozen O'Connor

(57) ABSTRACT

A loudspeaker arrangement includes a loudspeaker and a trigger circuit for electrically triggering the loudspeaker. The loudspeaker has a loudspeaker diaphragm for generating an acoustic signal. A digital pulse test signal is applied to the loudspeaker via the trigger circuit during a respective test sequence, the digital pulse test signal having a duty cycle that is predetermined to change such that the duty cycle increases over a plurality of periods of the test sequence at the beginning of the test sequence, and the duty cycle decreases over a plurality of periods of the test sequence at the end of the test sequence. During the respective test sequence, a measurement variable, representative of a voltage drop on a reference circuit connected in series to the loudspeaker, is detected, and the loudspeaker arrangement is classified as functional on the basis of a comparison of the measurement variable and a predetermined reference value.

7 Claims, 2 Drawing Sheets

METHOD AND DEVICE FOR TESTING A LOUDSPEAKER ARRANGEMENT

CROSS-REFERENCE TO RELATED APPLICATIONS

This is a U.S. national stage of application No. PCT/EP2012/074020, filed on 30 Nov. 2012, which claims priority to the German Application No. 10 2011 087 676.6, filed 2 Dec. 2011, the content of both incorporated herein by reference.

BACKGROUND OF THE INVENTION

1. Field of the Invention

The invention relates to a method and corresponding device for testing a loudspeaker arrangement including a loudspeaker, which includes a loudspeaker membrane.

2. Related Art

Modern motor vehicles are increasingly equipped with warning systems. By way of example, such warning systems include parking-aid systems, distance and speed warning systems, black-ice warning systems and/or microsleep warning systems. These warning systems usually employ acoustic signals for warning purposes. The acoustic warning signals are emitted by loudspeakers provided for the specific emission of the warning signals. Statutory safety requirements for motor vehicles require these loudspeakers to be tested in respect of the functionality thereof at regular intervals.

SUMMARY OF THE INVENTION

An object underlying the invention lies in developing a method and a device for testing a loudspeaker arrangement, which render it possible to test the functionality of the loudspeaker arrangement reliably.

The invention is distinguished by a method and a corresponding device for testing a loudspeaker arrangement that includes a loudspeaker. The loudspeaker has a loudspeaker membrane for generating an acoustic signal. Furthermore, the loudspeaker arrangement has an actuation circuit for electrically actuating the loudspeaker. A digital pulse test signal with a predetermined changing duty cycle is applied to the loudspeaker during a respective test sequence duration by the actuation circuit, the duty cycle being predetermined to change in such a way that, at the start of the test sequence duration, the duty cycle increases over a plurality of period durations of the test sequence duration and, at the end of the test sequence duration, the duty cycle reduces over a plurality of period durations of the test sequence duration. During the respective test sequence duration, a measurement variable is registered, which measurement variable is representative for a voltage drop across a reference circuit connected in series with the loudspeaker, and the loudspeaker arrangement is classified as being functional based on a comparison between the measurement variable and a predetermined reference value.

Advantageously, this enables a continuity test and a short-circuit test of the loudspeaker and a loudspeaker connection, for example plugs. The actuation circuit for the loudspeaker is likewise tested since the loudspeaker is actuated by the actuation circuit, and so the test also includes the actuation circuit. The method according to the invention and the device according to the invention thus respectively enable testing of the loudspeaker arrangement with great test depth and test safety. Compared to monitoring circuits embodied only to test the loudspeaker for an interruption of an electrical circuit, the method according to the invention and the device according to the invention can respectively obtain a substantially greater test depth and test safety.

The method according to the invention and the device according to the invention respectively enable simple, and therefore cost effective, and also reliable testing of the loudspeaker arrangement. In addition to an actuation circuit only embodied to actuate the loudspeaker during normal operation, only a few simple electronic components are additionally required for testing. Complicated components, such as, e.g., a microphone, are not required.

A further advantage lies in the fact that the duty cycle can be predetermined to change such that the loudspeaker membrane of the loudspeaker is deflected such that the deflection of the loudspeaker membrane, and hence the application of the pulse test signal on the loudspeaker, cannot be perceived by the human sense of hearing.

The loudspeaker arrangement can be arranged in a vehicle, for example in a motor vehicle. The loudspeaker arrangement can be provided for emitting acoustic warning signals and can be coupled to a control and/or monitoring unit of the motor vehicle in a signal-technical manner.

In accordance with one advantageous embodiment, a pulse frequency of the pulse test signal is greater than a natural frequency of the loudspeaker membrane. Advantageously, this renders it possible to avoid a natural oscillation of the loudspeaker membrane and to prevent the loudspeaker membrane from returning to its rest position between two pulses.

In accordance with a further advantageous embodiment, the pulse frequency of the pulse test signal is greater than a maximum audible frequency of humans. The maximum audible frequency of humans equals approximately 20 kHz. The pulse frequency, which can also be referred to as a carrier frequency of the pulse test signal, therefore lies outside of an audible range of humans.

In accordance with a further advantageous embodiment, the respective test sequence duration comprises a first time duration, a second time duration, which immediately follows the first time duration, and a third time duration, which immediately follows the second time duration. The duty cycle increases from 0% to 100% during the first time duration, the duty cycle is constant at 100% within the second time duration, and the duty cycle reduces from 100% to 0% during a third time duration. A rate at which the duty cycle respectively changes during the first time duration and/or the third time duration is selected in such a way that the reciprocal value of the rate represents a frequency that is lower than a minimum audible frequency of humans. The minimum audible frequency of humans equals approximately 16 Hz. The rate at which the duty cycle changes during the time duration and/or the third time duration can also be referred to as rate of change. Advantageously, this renders it possible to predetermine the deflection of the loudspeaker membrane in such a way that no sound waves audible by the human sense of hearing are generated by the loudspeaker membrane.

In accordance with a further advantageous embodiment, the duty cycle is predetermined to change such that the deflection of the loudspeaker membrane increases monotonically from a rest position value of the loudspeaker membrane to a predetermined deflection value during the first time duration, the deflection of the loudspeaker membrane has the predetermined deflection value during the second time duration, and the deflection decreases monotonically from the predetermined deflection value to the rest position value during the third time duration. Advantageously, this allows the deflection of the loudspeaker membrane to be predetermined such that higher and audible frequency components are able to be avoided and thus no sound waves audible by the human sense of hearing are generated by the loudspeaker membrane.

In accordance with a further advantageous embodiment, the duty cycle is predetermined to change such that the deflection of the loudspeaker membrane increases from the rest position value to the predetermined deflection value in accordance with an increasing $\sin^2$ function profile during the first time duration, the deflection of the loudspeaker membrane has the predetermined deflection value during the second time duration, and the deflection decreases from the predetermined deflection value to the rest position value in accordance with a decreasing $\sin^2$ function profile during the third time duration. This also renders it possible to predetermine the deflection of the loudspeaker membrane such that higher and audible frequency components are able to be avoided and thus no sound waves audible by the human sense of hearing are generated by the loudspeaker membrane. Furthermore, this can minimize the required memory footprint.

BRIEF DESCRIPTION OF THE DRAWINGS

Exemplary embodiments of the invention are explained below on the basis of the schematic drawings, in which.

DETAILED DESCRIPTION OF THE PRESENTLY PREFERRED EMBODIMENTS

Elements with the same structure or function have been provided with the same reference sign in a figure-overarching manner.

Figure 1:
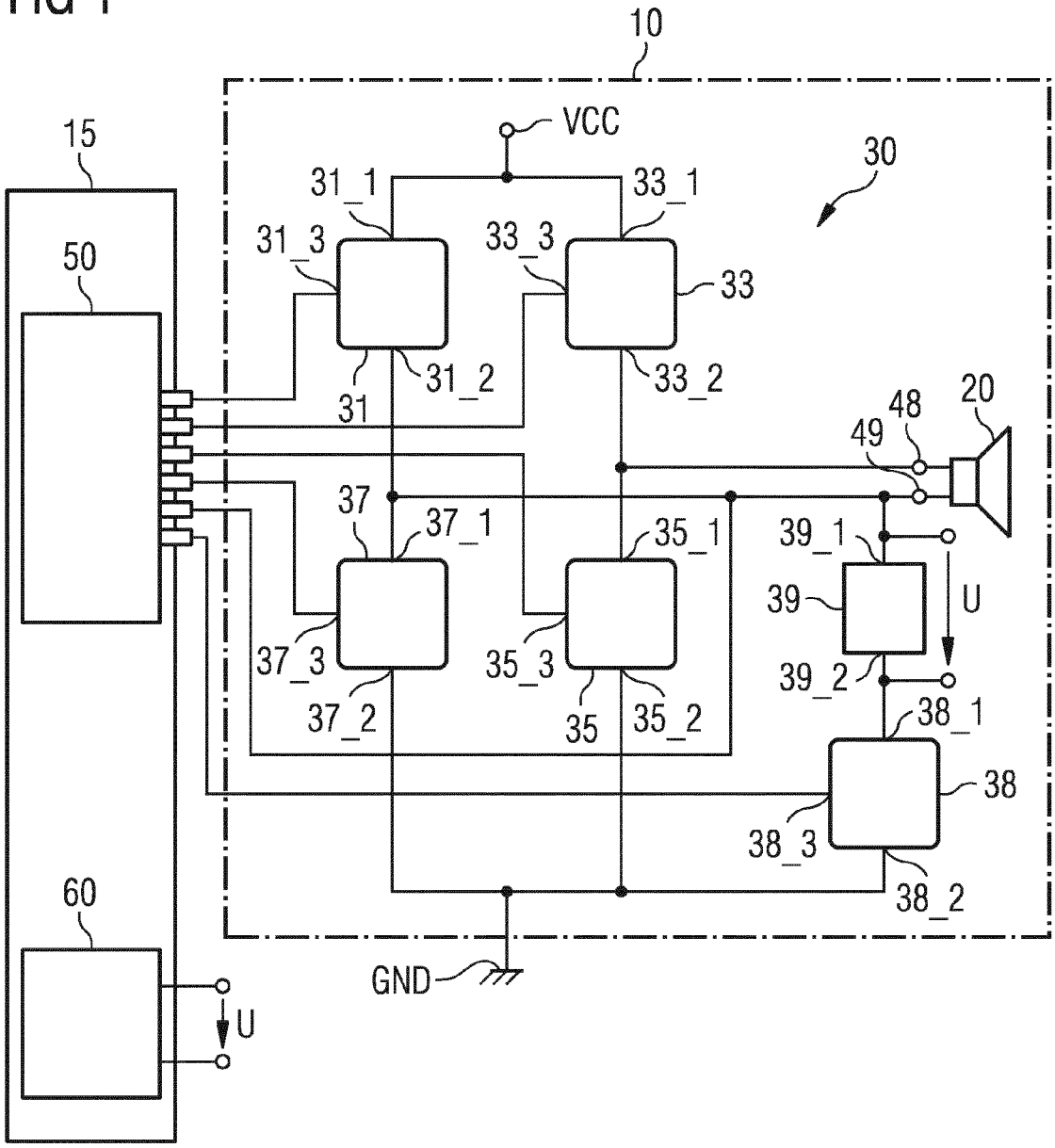
FIG. 1 shows a schematic illustration of a loudspeaker arrangement.

FIG. 1 shows a loudspeaker arrangement (10) comprising a loudspeaker (20) and an actuation circuit (30) for the loudspeaker (20), and also a device (15) for testing the loudspeaker arrangement (10). By way of example, the device (15) comprises a signal generator (50) and a measurement and evaluation apparatus (60).

Figure 2:
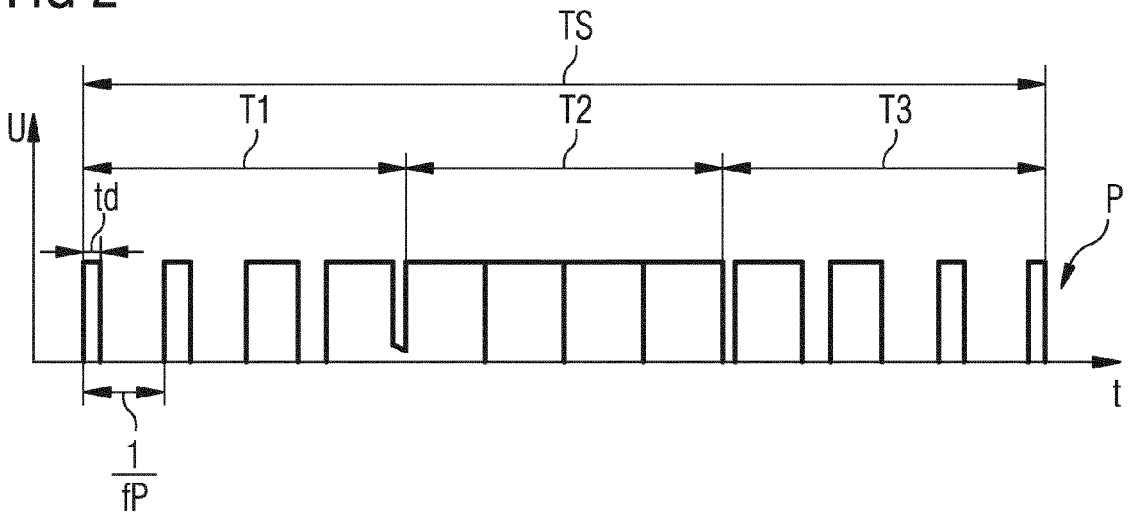
FIG. 2 shows an exemplary time profile of a pulse test signal.

By way of example, with reference to FIG. 2, the signal generator (50) is configured to generate a digital pulse test signal (P) with a predetermined changing duty cycle during a respective test sequence duration (TS), the duty cycle being predetermined to change such that, at the start of the test sequence duration (TS), the duty cycle increases over a plurality of period durations of the test sequence duration (TS) and, at the end of the test sequence duration (TS), the duty cycle reduces over a plurality of period durations of the test sequence duration (TS).

By way of example, the signal generator (50) can also be employed during normal operation of the loudspeaker arrangement (10) to emit digital signals, which represent the predetermined warning signals, to the actuation circuit (30).

The actuation circuit (30) is coupled in a predetermined manner to the signal generator (50). The actuation circuit (30) is electrically coupled to the loudspeaker (20). By way of example, the loudspeaker arrangement (10) and the device (15) are arranged in a motor vehicle. An arrangement in a different type of vehicle, for example an aircraft, or in a building is likewise possible. By way of example, the loudspeaker (20) is coupled via the actuation circuit (30) to a warning system of the motor vehicle, for example a distance warning system. The loudspeaker (20) is configured to generate acoustic signals depending on one or more control signals of the warning system.

The loudspeaker (20) has a loudspeaker membrane. By way of example, the loudspeaker (20) is embodied as an electrodynamic loudspeaker (20). The loudspeaker membrane of the electrodynamic loudspeaker is driven by an interaction between an electric current and a constant magnetic field. The electrodynamic loudspeaker (20) comprises a coil arranged in a constant magnetic field of a magnet. Alternating current can be applied to the coil such that a Lorenz force is generated, which exerts a force on the loudspeaker membrane, causing the latter to vibrate.

By way of example, the actuation circuit (30) comprises a full-bridge circuit for actuating the loudspeaker (20). Alternatively, the actuation circuit (30) can comprise a different suitable amplifier circuit known to a person skilled in the art, for example a half-bridge circuit.

By way of example, the loudspeaker (20) is arranged in a diagonal of the full-bridge circuit. By way of example, the full-bridge circuit comprises four switching elements (31, 33, 35, 37), a first (31), a second (33), a third (35) and a fourth switching element (37). The first (31) and the second switching element (33) respectively comprise, e.g., a driver circuit with, for example, a pnp-bipolar transistor in each case. The third (35) and fourth (37) switching element respectively comprise, e.g., a driver circuit with, for example, an npn-bipolar transistor. Alternatively, transistors of a different type, for example field effect transistors, can be used for the driver circuits.

Furthermore, the actuation circuit (30) comprises a fifth switching element (38) and a reference circuit (39). The fifth switching element (38) comprises, e.g., a driver circuit with, for example, an npn-bipolar transistor. By way of example, the reference circuit (39) has an impedance. By way of example, the impedance is selected such that it is at least approximately equal to an input impedance of the loudspeaker (20). By way of example, the impedance can comprise an ohmic resistor having a resistance value of 10 Ohms.

A respective first connection node (31_1), (33_1) of the first switching element (31) and of the second switching element (33) is, for example, electrically coupled to the supply voltage VCC. A second connection node (31_2) of the first switching element (31) is electrically coupled to a first connection node (37_1) of the fourth switching element (37). A second switching node (37_2) of the fourth switching element (37) is electrically coupled to a reference potential (GND). A second connection node (33_2) of the second switching element (33) is electrically coupled to a first connection node (35_1) of the third switching element (35). A second connection node (35_2) of the third switching element (35) is electrically coupled to the reference potential (GND). A first connector (48) of the loudspeaker (20) is electrically coupled to the second connection node (33_2) of the second switching element (33) and to the first connection node (35_1) of the third switching element (35).

A second connector (49) of the loudspeaker (20) is electrically coupled to the second connection node (31_2) of the first switching element (31), the first connection node (37_1) of the fourth switching element (37) and to a first connection point (39_1) of the reference circuit (39). A second connection point (39_2) of the reference circuit (39) is electrically coupled to a first connection node (38_1) of the fifth switching element (38). The second connection node (38_2) of the fifth switching element (38) is electrically coupled to the reference potential (GND).

The switching elements (31, 33, 35, 37, 38) each have one control connector (31_3, 33_3, 35_3, 37_3, 38_3). The control connectors (31_3, 33_3, 35_3, 37_3, 38_3) of the switching elements (31, 33, 35, 37, 38) are electrically coupled in a predetermined manner to the outputs of the signal generator (50).

During normal operation of the loudspeaker (20), the fifth switching element (38) has a locked operating state such that no current can drain via the reference circuit (39) and the fifth switching element (38). During normal operation, the first (31) and the fourth switching element (37) are actuated inversely with respect to one another and the second (33) and third switching element (35) are likewise actuated inversely with respect to one another. What this brings about is that current can flow alternately in a first direction and in a second direction through the loudspeaker (20).

During a test operation of the loudspeaker arrangement (10), the fifth switching element (38) replaces the fourth switching element (37) or it is actuated analogously to the fourth switching element (37) in addition to the fourth switching element (37). This allows the current to flow at least in part through the reference circuit (39) and a voltage drop is produced between the first connection point (39_1) and the second connection point (39_2) of the reference circuit (39), which voltage drop can be registered by the measurement and evaluation apparatus (60). By way of example, the measurement and evaluation apparatus (60) can comprise a suitably designed analog/digital transducer. An advantage of such an arrangement is that a separate test of an analog/digital transducer input is not required since only a functional analog/digital transducer can produce a suitable measurement signal.

By way of example, the measurement and evaluation apparatus (60) is embodied to register a measurement variable (U) during the respective test sequence duration (TS), which measurement variable is representative for the voltage drop across the reference circuit (39) connected in series with the loudspeaker (20), and the loudspeaker arrangement (10) is classified as being functional dependent on a comparison between the measurement variable (U) and a predetermined reference value.

FIG. 2 shows, in an exemplary manner, a time profile of the pulse test signal (P) during the respective test sequence duration (TS). In each case, one or more test sequence durations (TS) can be evaluated for testing the loudspeaker arrangement (10).

By way of example, the loudspeaker arrangement (10) can be tested at predetermined time intervals during operation of the motor vehicle and/or at the start of operation of the motor vehicle and/or just before the start of operation of the motor vehicle. By way of example, provision can be made for the loudspeaker arrangement (10) to be tested every time a vehicle driver enters the motor vehicle. By way of example, for this purpose, a suitably designed sensor can detect whether an occupancy of a vehicle driver's seat has changed.

The pulse test signal (P) has a duty cycle changing in a predetermined manner. The duty cycle is predetermined to change such that, at the start of the test sequence duration (TS), the duty cycle increases over a plurality of period durations of the test sequence duration (TS) and, at the end of the test sequence duration (TS), the duty cycle reduces over a plurality of period durations of the test sequence duration (TS).

By way of example, the respective test sequence duration (TS) can comprise a first time duration (T1), a second time duration (T2), which immediately follows the first time duration (T1), and a third time duration (T3), which immediately follows the second time duration (T2). By way of example, the duty cycle increases from 0% to 100% during the first time duration (T1), the duty cycle is constant at 100% within the second time duration (T2), and the duty cycle reduces from 100% to 0% during a third time duration (T3). A rate at which the duty cycle respectively changes during the first time duration (T1) and/or the third time duration (T3) is selected such that the reciprocal value of the rate represents a frequency that is lower than a minimum audible frequency of humans.

By way of example, the test sequence duration (TS) can be 100 ms. The test sequence duration (TS) should preferably be selected such that the test sequence frequency corresponding to the test sequence duration (TS) is less than the minimum audible frequency of humans to ensure that the deflection (L) of the loudspeaker membrane does not produce any sound waves which have frequency components that are audible to the human sense of hearing. By way of example, the first (T1) and third time duration (T3) can be 25 ms in each case.

During the test sequence duration (TS) the measurement variable (U) is registered, which is representative for a voltage drop across a reference circuit (39) connected in series with the loudspeaker (20), and the loudspeaker arrangement (10) is classified as being functional depending on a comparison between the measurement variable (U) and a predetermined reference value. By way of example, the measurement variable (U) can be registered and evaluated once or a number of times during the second time duration (T2).

Figure 3:
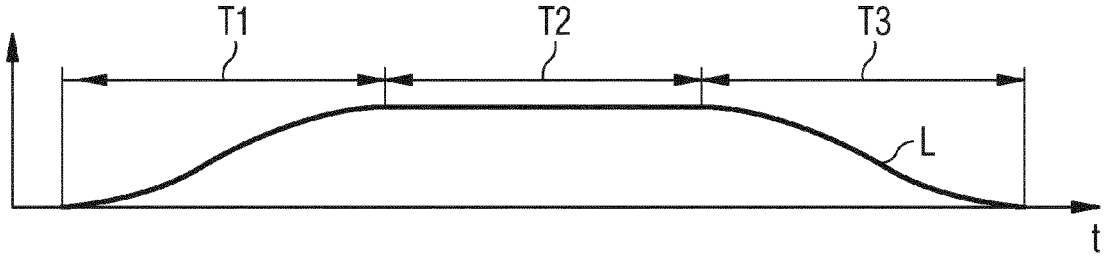
FIG. 3 shows an exemplary time profile of a deflection of a loudspeaker membrane.

FIG. 3 shows an exemplary time profile of a deflection (L) of the loudspeaker membrane. By way of example, the duty cycle can be predetermined to change such that the deflection (L) of the loudspeaker membrane increases monotonically from a rest position value of the loudspeaker membrane to a predetermined deflection value during the first time duration (T1), the deflection (L) of the loudspeaker membrane has the predetermined deflection value during the second time duration (T2), and the deflection (L) decreases monotonically from the predetermined deflection value to the rest position value during the third time duration (T3).

By way of example, the duty cycle can be predetermined to change such that the deflection (L) of the loudspeaker membrane increases from the rest position value to the predetermined deflection value in accordance with an increasing $\sin^2$ function profile during the first time duration (T1), the deflection (L) of the loudspeaker membrane has the predetermined deflection value during the second time duration (T2), and the deflection (L) decreases from the predetermined deflection value to the rest position value in accordance with a decreasing $\sin^2$ function profile during the third time duration (T3).

Figure 4:
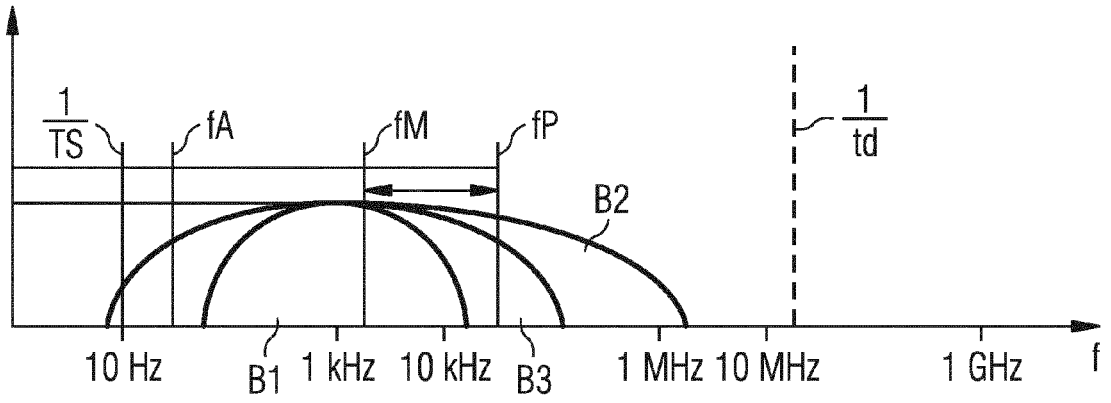
FIG. 4 shows a frequency diagram.

FIG. 4 shows a frequency diagram with an audible frequency range (B1) of humans and a functional frequency range (B2) of the loudspeaker (20), within which the loudspeaker membrane can be deflected. By way of example, the loudspeaker membrane has an upper maximum limit frequency, up to which there can be a deflection of the loudspeaker membrane. Furthermore, a third frequency range (B3) is shown, which represents a transition region of the loudspeaker (20), in which the loudspeaker (20) is preferably operated.

Furthermore, FIG. 4 shows various frequencies in relation to the pulse test signal (P) and the loudspeaker (20).

A pulse frequency (fP) of the pulse test signal (P) is constant. By way of example, the pulse frequency (fP) of the pulse test signal (P) is greater than a natural frequency (fM) of the loudspeaker membrane. By way of example, the natural frequency (fM) of the loudspeaker membrane is 3 kHz. By way of example, the pulse frequency (fP) of the pulse test signal (P) is greater than a maximum audible frequency for humans. The pulse frequency (fP) is preferably selected in such a way that it is less than the upper maximum limit frequency of the loudspeaker (20).

By way of example, the test sequence duration (TS) can be 100 ms. By way of example, the test sequence is repeated at predetermined time intervals. By way of example, the test sequence frequency corresponding to the test sequence duration (TS) is 10 Hz. The test sequence frequency is preferably selected such that it lies below the audible frequency range (B1) of humans.

The first pulse of the pulse test signal (P) has a very short pulse duration (td), for example 20 ns; that is to say, the lowest frequency component of the first pulse lies at approximately 20 MHz and therefore a long way outside of the audible frequency range (B1). Such a short pulse does not yet enable a membrane deflection. By way of example, it is for this reason that the duty cycle is predetermined to change such that during the first time duration (T1) the deflection (L) of the loudspeaker membrane increases during the first time duration (T1) from the rest position value to the predetermined deflection value in accordance with an increasing $\sin^2$ function profile. What this type of deflection (L) brings about is that higher and audible frequency components can be greatly reduced. By way of example, a frequency (fA) of the increase can be established by a Fourier transformation of the profile of the deflection (L) of the loudspeaker membrane. The frequency of the increase in this case is less than a minimum audible frequency of humans.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for testing a loudspeaker arrangement (10) having a loudspeaker (20) that has a loudspeaker membrane configured to generate an acoustic signal, and an actuation circuit (30) configured to electrically actuate the loudspeaker (20), the method comprising:

applying, by the actuation circuit (30), a digital pulse test signal (P) with a predetermined changing duty cycle to the loudspeaker (20) during a respective test sequence duration (TS), the duty cycle being predetermined to change such that, at the start of the test sequence duration (TS), the duty cycle increases over a plurality of period durations of the test sequence duration (TS) and, at the end of the test sequence duration (TS), the duty cycle reduces over a plurality of period durations of the test sequence duration (TS);

registering a measurement variable (U) during the respective test sequence duration (TS), the measurement variable being representative of a voltage drop across a reference circuit (39) connected in series with the loudspeaker (20); and classifying the loudspeaker arrangement as being functional based on a comparison between the measurement variable (U) and a predetermined reference value.

2. The method as claimed in claim 1, wherein a pulse frequency (fP) of the pulse test signal (P) is greater than a natural frequency (fM) of the loudspeaker membrane.

3. The method as claimed in claim 2, wherein the pulse frequency (fP) of the pulse test signal (P) is greater than a maximum audible frequency of humans.

4. The method as claimed in claim 1, wherein:

the respective test sequence duration (TS) comprises a first time duration (T1), a second time duration (T2), which immediately follows the first time duration (T1), and a third time duration (T3), which immediately follows the second time duration (T2), the duty cycle increases from 0% to 100% during the first time duration (T1), the duty cycle is constant at 100% within the second time duration (T2), and the duty cycle reduces from 100% to 0% during a third time duration (T3), wherein a rate at which the duty cycle respectively changes during the first time duration (T1) and/or the third time duration (T3) is selected such that the reciprocal value of the rate represents a frequency that is lower than a minimum audible frequency of humans.

5. The method as claimed in claim 4, wherein the duty cycle is predetermined to change such that the deflection (L) of the loudspeaker membrane increases monotonically from a rest position value of the loudspeaker membrane to a predetermined deflection value during the first time duration (T1), a deflection (L) of the loudspeaker membrane has the predetermined deflection value during the second time duration (T2), and the deflection (L) decreases monotonically from the predetermined deflection value to the rest position value during the third time duration (T3).

6. The method as claimed in claim 5, wherein the duty cycle is predetermined to change such that the deflection (L) of the loudspeaker membrane increases from the rest position value to the predetermined deflection value in accordance with an increasing $\sin^2$ function profile during the first time duration (T1), the deflection (L) of the loudspeaker membrane has the predetermined deflection value during the second time duration (T2), and the deflection (L) decreases from the predetermined deflection value to the rest position value in accordance with a decreasing $\sin^2$ function profile during the third time duration (T3).

7. A device (15) for testing a loudspeaker arrangement (10) having a loudspeaker (20) that has a loudspeaker membrane configured to generate an acoustic signal, and an actuation circuit (30) configured to electrically actuate the loudspeaker (20), the device being configured to:

apply, by the actuation circuit (30), a digital pulse test signal (P) with a predetermined changing duty cycle to the loudspeaker (20) during a respective test sequence duration (TS), the duty cycle being predetermined to change such that, at the start of the test sequence duration (TS), the duty cycle increases over a plurality of period durations of the test sequence duration (TS) and, at the end of the test sequence duration (TS), the duty cycle reduces over a plurality of period durations of the test sequence duration (TS);

register a measurement variable (U) during the respective test sequence duration (TS), the measurement variable being representative of a voltage drop across a reference circuit (39) connected in series with the loudspeaker (20); and classify the loudspeaker arrangement as being functional based on a comparison between the measurement variable (U) and a predetermined reference value.

* * * * *